United States Patent [19]

Hemsath et al.

[11] Patent Number: 4,693,015

[45] Date of Patent: Sep. 15, 1987

[54] DIRECT FIRED CYLINDER DRYER

[75] Inventors: Klaus H. Hemsath; Being-I Fu, both of Toledo, Ohio

[73] Assignee: Hercules Incorporated, Wilmington, Del.

[21] Appl. No.: 769,388

[22] Filed: Aug. 26, 1985

[51] Int. Cl.[4] ..... F26B 3/24; F26B 13/08

[52] U.S. Cl. ..... 34/41; 34/119; 34/124; 432/60; 432/228

[58] Field of Search ..... 165/90; 34/119, 124, 34/113, 41; 432/60, 228, 246

[56] References Cited

U.S. PATENT DOCUMENTS

| | | | |
|---|---|---|---|
| 1,669,774 | 5/1928 | O'Malley . | |
| 1,819,534 | 8/1931 | Akerlow . | |
| 1,884,727 | 10/1932 | Kermer . | |
| 1,925,702 | 9/1933 | Nelson | 257/95 |
| 2,225,166 | 12/1940 | Erby | 34/48 |
| 2,322,957 | 6/1943 | Sullivan | 38/65 |
| 2,367,578 | 1/1945 | Helin | 257/93 |
| 2,915,293 | 12/1959 | Justus et al. | 257/95 |
| 2,984,472 | 5/1961 | Marks | 263/6 |
| 2,987,305 | 6/1961 | Calhoun, Jr. | 263/6 |
| 3,022,047 | 2/1962 | Swaney | 257/95 |
| 3,325,910 | 6/1967 | Toivonen | 34/124 |
| 3,352,298 | 11/1967 | Hope | 126/350 |
| 3,401,745 | 9/1968 | Pato et al. | 165/90 |
| 3,426,839 | 2/1969 | Overton | 34/124 |
| 3,452,967 | 7/1969 | Durand | 263/6 |
| 3,729,180 | 4/1973 | Bourrel et al. | 263/6 C |
| 4,090,841 | 5/1978 | Kramlehner | 432/60 |
| 4,146,972 | 4/1979 | Smith | 34/41 |
| 4,252,184 | 2/1981 | Appel | 165/90 |
| 4,494,318 | 1/1985 | Smillie | 432/228 |
| 4,562,655 | 1/1986 | Bosshart et al. | 432/60 |

*Primary Examiner*—Larry I. Schwartz

*Attorney, Agent, or Firm*—Fay, Sharpe, Beall, Fagan, Minnich & McKee

[57] ABSTRACT

A drying cylinder (A) is mounted for rotation about its central axis (44). A burner assembly (B) oxidizes fuel interior to the shell, generally along the central axis. A recirculating fan (C) urges the hot combustion gases from the burner into a nozzle box assembly (D). The nozzle box assembly includes a plurality of peripherally spaced, longitudinally extending boxes (80) which have an array of nozzles (82) therein. The nozzles direct jets of hot combustion gases against an interior surface of a cylindrical dryer shell (30) for transferring heat thereto. Hot combustion gases which have impinged upon the shell are recirculated through passages (84) and are in part reheated by the burner and in part discharged through an exhaust aperture (90) and an exhaust duct (92). In one embodiment, the direct fired dryer is mounted in one of the dryer sections of a Fourdrinier paper production line. In another embodiment, particulates and other non-sheet materials are applied to the dryer shell, dried as the dryer shell rotates, and the dried materials are removed.

18 Claims, 5 Drawing Figures

DIRECT FIRED CYLINDER DRYER

BACKGROUND OF THE INVENTION

The present invention relates to drying apparatae and methods. The invention finds particular application in connection with cylindrical dryers for use in the Fourdrinier paper making process and will be described with particular reference thereto. It is to be appreciated, however, that the present invention will find utility in connection with other drying and heating processes for particulates, other sheet-like goods, and other materials.

Heretofore, steam has been the primary energy source for drying paper. In a typical paper manufacturing process, 90 to 300 pounds of water are removed for each pound of paper produced. Significant fractions of the water are removed mechanically in a forming section as the paper is formed, and in a pressing section as the paper is squeezed between rollers. In the pressing section, the cost of dewatering the paper is about forty times as much per gallon as in the forming section. Commonly, the paper leaves the pressing section with a dryness of about 40%, wet basis. To dry the paper to a 92–95% dryness required for the finished product, another 1 to 2 pounds of water per pound of paper are removed in a drying section. Conventionally, the drying section included a plurality of steam heated rollers around which the paper web passed. The cost per gallon of water removed in the dryer section was typically about 80 times the cost per gallon in the forming section.

The Fourdrinier paper making process is suitable for manufacturing paper of varying grades. Heavier grades of paper, such as linerboard or paper board, require more energy per linear foot during the drying stage than lighter grades. Commonly, steam heated drying cylinders which are sized for lighter grades of paper achieve too low a thermal head to dry the heavier paper grades at full, normal production rates. To dry heavier grades, the manufacturing rate of the entire system must be reduced.

Additional thermal energy cannot be obtained from steam dryers because the maximum pressure for these dryers is limited to 160 psig by the ASME Unfired Pressure Vessel Code. This achieves a saturated temperature of about 370° F. Adding steam cylinders and increasing the corresponding steam production to handle heavier paper grades adds considerable production expense. Moreover, adding additional steam drying rollers, which are commonly 5–6 feet or more in diameter, requires a significant lengthening of the manufacturing line and, in many instances, of the physical facilities necessary to house the line.

The present invention overcomes the above-noted problems and disadvantages, and provides an improved high thermal head dryer which increases drying capacity, provides better performance, and is adaptable to effective use with a wide range of paper grades.

SUMMARY OF THE INVENTION

In accordance with the present invention, a direct fired, jet impingement dryer is provided. A cylindrical dryer shell is mounted for rotation about a central axis thereof, and a burner oxidizes fuel and directs hot combustion gases along this central axis. A hot gas urging means urges the hot combustion gases from the interior of the shell into a nozzle box assembly. The nozzle box assembly has a plurality of outwardly directed nozzles disposed adjacent an interior surface of the dryer shell for directing jets of gas thereagainst. In this manner, jets of hot combustion gases passing through the nozzles impinge on the dryer shell and transfer heat thereto.

In accordance with another aspect of the invention, a method of drying a continuous web, such as paper, is provided. The continuous web is passed along an exterior surface of a rotating dryer shell. Within the cylinder, fuel is oxidized to generate hot combustion gases. Jets of the hot combustion gases are directed against an interior surface of the rotating dryer shell.

According to still another aspect of the invention, a paper making system is provided which includes a Fourdrinier paper forming section for forming a continuous web of paper and a pressing section for squeezing the paper web flat and relatively dry. A steam drying section removes additional water from the paper web. One or more direct fired, jet impingement dryer cylinders are disposed downstream from the steam drying section to complete the drying process.

A primary advantage of the invention is an increase in drying capacity and production speeds.

Another advantage of the invention is found in the excellent thermal and mechanical performance realized therefrom.

Yet another advantage of the invention resides in the flexibility of producing a wide range of paper grades at full production speeds.

Still other advantages and benefits of the subject invention will become apparent to those skilled in the art upon a reading and understanding the following detailed specification.

BRIEF DESCRIPTION OF THE DRAWINGS

The invention may take form in certain parts and arrangements of parts, a preferred embodiment of which will be described in this specification and illustrated drawings which form a part hereof and wherein.

DETAILED DESCRIPTION OF THE PREFERRED EMBODIMENT

Figure 1:
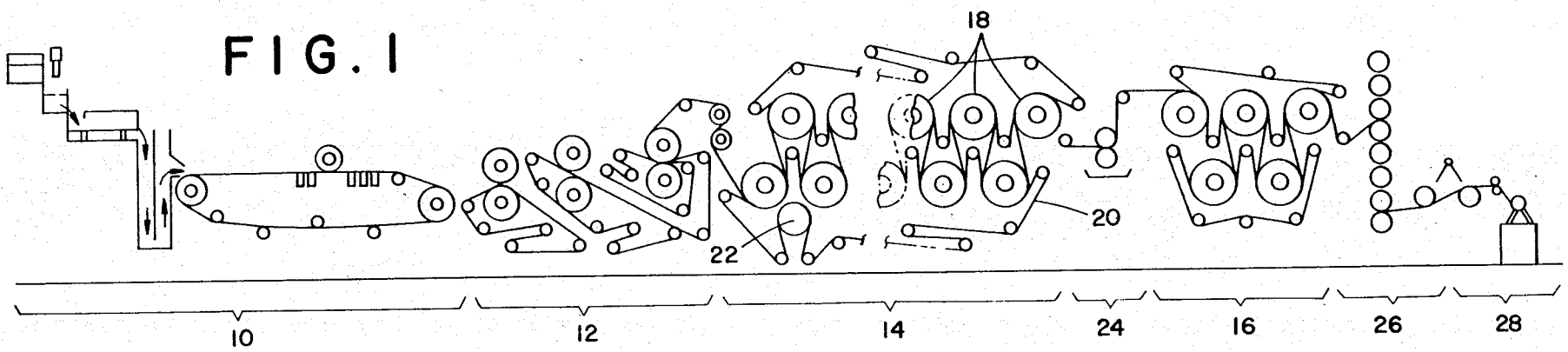
FIG. 1 schematically illustrates a Fourdrinier paper making system of the general type to which the subject invention is adapted to use.

Referring now to the drawings wherein the showings are for purposes of illustrating a preferred embodiment of the invention only and not for purposes of limiting same, FIG. 1 schematically illustrates a Fourdrinier paper making system having a forming section 10 which generates a continuous web of partially dewatered paper. A first or pressing section 12 presses the web to smooth its surface and to continue the dewatering process. A plurality of intermediate dryer sections 14 and a final dryer section 16 drive the moisture from the paper web. In each dryer section, the paper web is held against paper dryer rolls 18 with felt belts 20. One or more felt dryer rolls 22 eliminates excess moisture from the felt belts. At least one of the paper and felt dryer rolls is a direct fired, jet impingement dryer. Preferably, the majority of paper and felt dryer rolls are conventional steam heated dryer rolls. One or more sizing presses 24 are disposed between dryer sections to adjust the physical dimensions of the paper web. The dried paper is ironed in calender rolls 26 and wound by a winder 28. By selectively increasing the firing rate of the direct fired impingement dryer, heavy grades of paper can be manufactured at substantially full manufacturing speed. By lowering the firing rate of the direct fired impingement dryer, the same paper manufacturing line can manufacture light grades of paper without overdrying.

Figure 2:
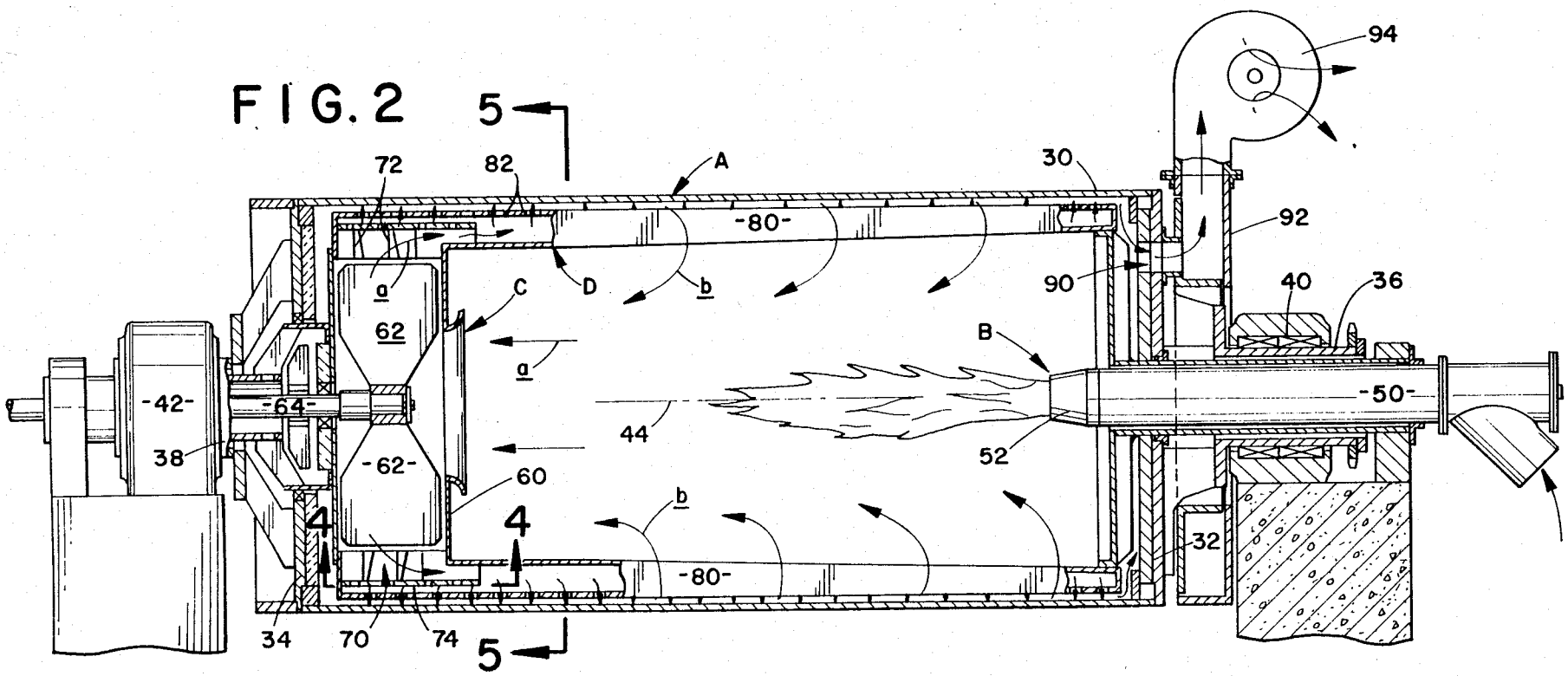
FIG. 2 is a longitudinal cross-sectional view of a direct fired, jet impingement drying cylinder formed in accordance with the subject invention.

With particular reference to FIG. 2, each direct fired, jet impingement dryer includes a generally cylindrical dryer shell A. A burner B oxides fuel and directs hot combustion gases along the interior of the dryer shell. An urging means C, such as a recirculation fan or the like, urges the hot combustion gases from the interior of the dryer shell into a nozzle box assembly D. The nozzle box assembly D is disposed on the interior to the dryer shell A to direct jets of hot combustion gases thereagainst. The total energy produced is selectively adjusted by adjusting the combustion rate, and the rate of heat transfer to the dryer shell is controlled by varying the speed of the recirculation fan to adjust the velocity of the hot gas jets impinging on the dryer shell.

The dryer shell A is comprised of a cylindrical metal shell 30 having opposite first and second end walls 32, 34. The end walls are mounted on first and second tubular shafts 36, 38 which are journalled in suitable bearings 40, 42. In this manner, the dryer shell is configured for rotation about a central axis 44.

Burner B includes an air/gas supply tube 50 which extends through the first tubular shaft 36 to supply an air/gas mixture to a burner or combustion apparatus 52. The burner 52 is dimensioned so as to have a smaller diameter than the interior of the first tubular shaft 36 to facilitate periodic removal of the burner for replacement and repair. The burner 52 is centrally mounted and configured to direct the flame generally along the central axis 44 of the shell. Preferably, the air/gas supply has a high turn down ratio to enable wide adjustment in the amount of heat supplied to the dryer. An excess of air over and above the minimal requirements for combustion is supplied to the burner such that the hot combustion gases have sufficient oxygen to support additional combustion.

Figure 3:
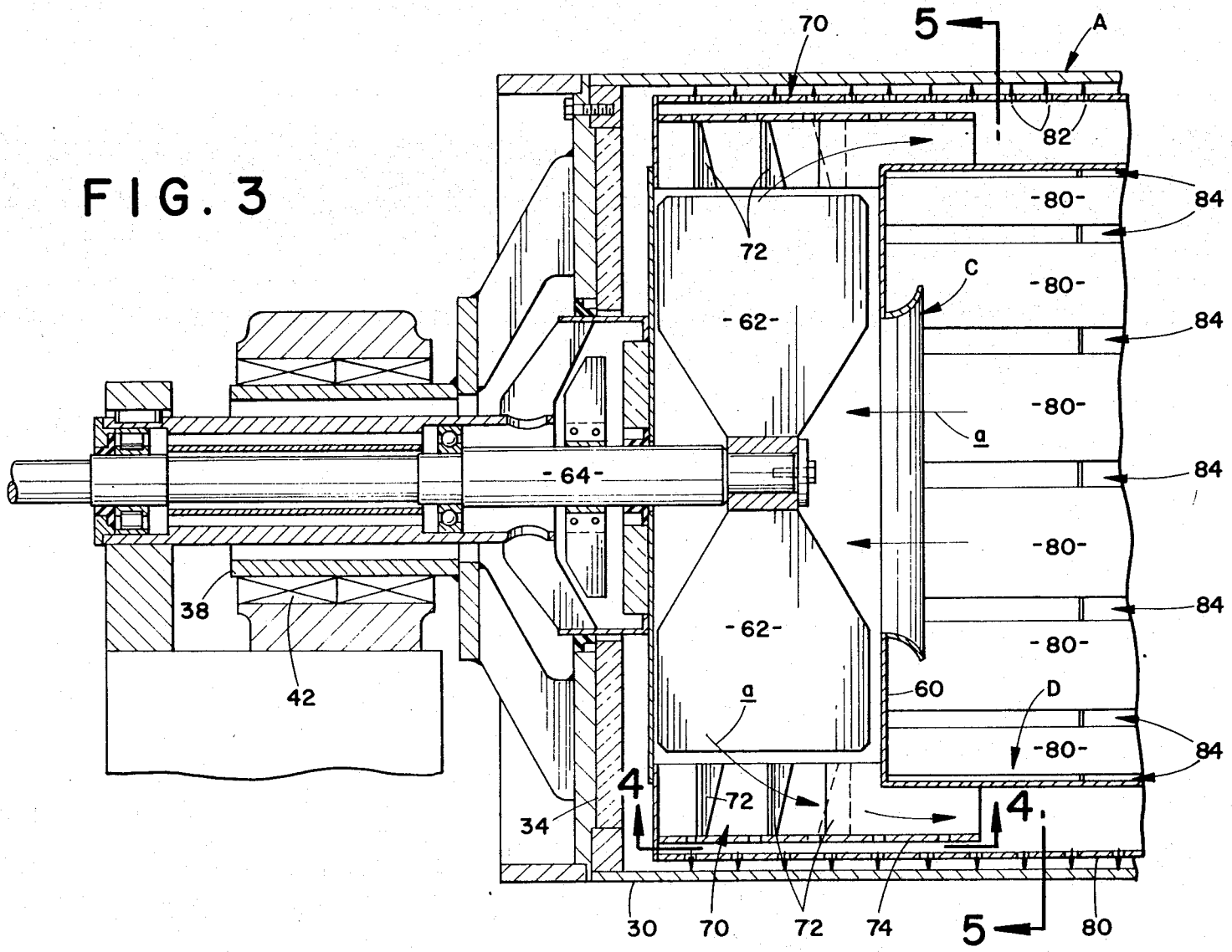
FIG. 3 is an enlarged view of the recirculating end of the drying cylinder shown in FIG. 2.

With continuing reference to FIG. 2 as well as with reference to FIG. 3, the urging means C includes an intake baffle 60 having a central opening through which hot combustion gases are drawn. Fan blades 62 mounted on a water cooled rotating shaft 64 are oriented to pull the hot combustion gases axially of the shell through the central opening in baffle 60 and expel them circumferentially. This flow is designated by arrows a in FIGS. 2 and 3. The fan shaft 64 extends axially through the second shell mounting shaft 38 and communicates with a suitable drive means (not shown) such as an electric motor.

Figure 4:
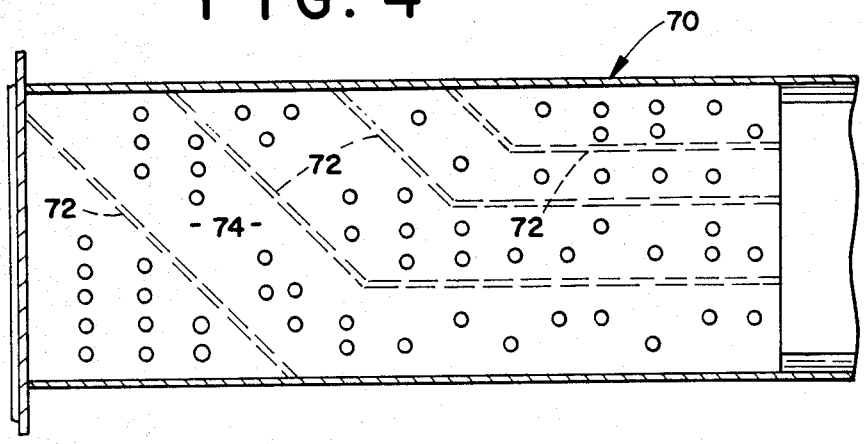
FIG. 4 is cross-sectional taken along lines 4—4 of FIG. 3.

As best shown in FIGS. 3 and 4, a plurality of gas directing means 70 direct the air from the circumference of the recirculating fan into the nozzle box assembly D. Because the rotation of the recirculating fan tends to create strong swirls in the flow pattern, the gas directing means includes turbulence reducing means for providing a relatively uniform, static pressure distribution across the nozzle box assembly. The turbulence reducing means in the preferred embodiment shown includes a plurality of turning vanes 72 which distribute the hot combustion gases across the nozzle box assembly and act as buffers to reduce the pressure nonuniformity caused by the swirl motion. The turbulence reducing means further includes a plurality of perforated plates 74 which define a plurality of apertures. These perforated plates create greater uniformity in the pressure and reduce the dynamic air flow to static pressure.

Figure 5:
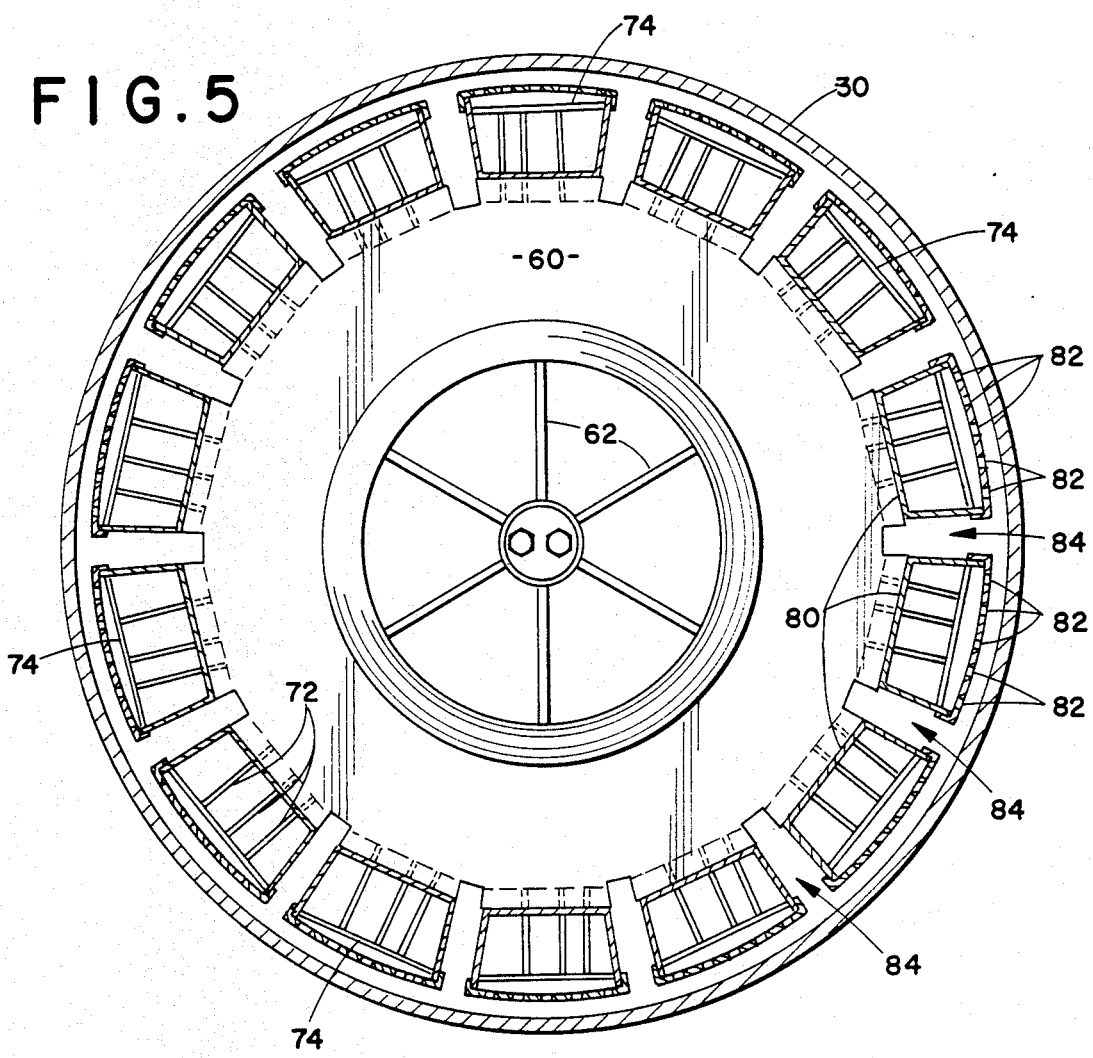
FIG. 5 is a cross-sectional taken along lines 5—5 of FIG. 3.

With reference again to FIGS. 2 and 3, and also with reference to FIG. 5, the nozzle box assembly D includes a plurality of nozzle boxes or channels 80 extending longitudinally of the shell 30. The plurality of nozzle boxes are disposed in a regular, spaced peripheral array surrounding the central axis 44 in close spaced relation to the shell. The nozzle boxes define a plurality of apertures or nozzles 82 in the outermost surface thereof to direct jets of air from the nozzle box toward the shell interior surface. Gas return passages 84 are defined between adjacent nozzle boxes to permit the gases which have transferred heat to the shell to be recirculated toward the combustion area and reheated as shown by arrows b in FIG. 2.

Preferably, the nozzle boxes have a tapered cross-section which is greatest adjacent the recirculation fan and smallest adjacent the burner. The degree of tapering is selected in conjunction with the size of the nozzles 82 such that a substantially constant gas pressure is maintained along the length of each nozzle box. Constant, static pressure, in turn, maintains the gas jet pressure, hence heat transfer, substantially uniform along the length of the shell. Various other changes in cross-section, baffles, passages, and the like may be provided to maintain the gas jets from the nozzles substantially uniform along the length of each nozzle box. Alternately, the nozzle boxes may have a constant cross section along the length of the shell.

As shown in FIG. 2, the first shell end wall 32 defines a plurality of exhaust apertures 90 therethrough. The exhaust apertures 90 are disposed generally equidistant from the central axis 44 to maintain registration with an annular exhaust duct 92. The exhaust duct is connected with an air blower or other means 94 for maintaining a negative pressure in the exhaust duct. In this manner, ambient air is drawn through the interface between the exhaust duct and the first end wall 32 to prevent leakage of exhaust fumes therethrough.

Unlike the prior art steam dryers which rely on the condensation of steam to achieve heat transfer, the present jet impingement dryers utilize highly efficient forced convection heat transfer. The heat transfer increases with both the velocity of gas in the jets and the temperature of gas. However, the higher the jet temperature, the more temperature resistant the nozzle boxes must be.

Moreover, the low thermal inertia of the system provides excellent controllability of the heat transfer under a paper break or other emergency conditions. Stopping or reducing the recirculation fan speed rapidly decreases the jet velocity, hence the heat transfer. Likewise, stopping or reducing the combustion rate cuts the thermal energy, hence the heat transfer rate. In the preferred embodiment, it has been found that the shell temperature can be successfully maintained below 370° F. during a paper break or other emergency condition in which wet paper or other material is not available to absorb thermal energy from the shell.

In an alternate embodiment, the direct fired, jet impingement dryer is utilized to dry particulates rather than sheet goods. An applicator, such as a sprayer, deposits a layer of moist particulate material to the outer shell of the dryer. As the shell rotates the particulate material from the application station, the moisture is driven off. At a removal station disposed about a half to three-fourths of a revolution from the application station, a removal means, such as a scraper blade, removes the dried particulate material. Alternately, the particulates may be applied to a web which passes around the direct fired dryer.

The particulates may have been ground in a water slurry, may be a condensation product from a chemical reaction, or the like. Moreover, the heat from the dryer may be used to advance a chemical reaction, polymerization, uniform crystallization, and other material treatments. Particles of various pharmaceuticals, pigments, minerals, and the like may be dried or treated in this manner.

The invention has been described with reference to the preferred embodiment. Obviously, modifications and alterations will occur to others upon a reading and understanding of the preceding detailed description. It is intended to include all such modifications and alterations insofar as they come within the scope of the appended claims or equivalents thereof.

Having thus described the invention, it is now claimed:

1. A jet impingement dryer comprising:

(a) a generally cylindrical dryer shell having an interior surface and an exterior surface over which a material to be dried is engaged, the dryer shell being mounted for rotation about its central axis;

(b) a nozzle box assembly non-rotatably disposed more closely adjacent the dryer shell interior surface than the dryer shell central axis, the nozzle box assembly including plural channels extending longitudinally of the shell and spaced in peripheral array surrounding the central axis defining a plurality of nozzles directed toward the dryer shell interior surface;

(c) a burner assembly for oxidizing fuel and directing hot combustion gases into the interior of the dryer shell; and, (d) means for urging the hot combustion gases into the nozzle box assembly such that jets of the hot combustion gases pass through the nozzles and impinge on the dryer shell interior surface for substantially uniformly heating same as the dryer shell rotates relative to the nozzle box assembly.

2. The dryer as set forth in claim 1 wherein the nozzle box assembly is generally cylindrical.

3. The dryer as set forth in claim 1 wherein recirculation passages are defined between adjacent ones of the channels.

4. The dryer as set forth in claim 3 wherein each channel includes a tapering internal cross-section which decreases with distance from the urging means such that all nozzles emit gas of generally the same velocity.

5. The dryer as set forth in claim 1 wherein the shell includes at least one rotatably journalled, hollow, end mounting shaft, and wherein the burner includes an air and fuel supply passage extending longitudinally through the mounting shaft for supplying air and fuel to a burner head disposed within the shell.

6. The dryer as set forth in claim 5 wherein the burner head has a maximum diameter which is less than the hollow interior of the mounting shaft such that the burner is insertable and removable therethrough to facilitate replacement and repair thereof.

7. The dryer as set forth in claim 1 further including means for converting hot gases issuing from the urging means into static pressure in the nozzle boxes assembly.

8. The dryer as set forth in claim 1 wherein the urging means includes a recirculation fan for drawing hot combustion gases generally axially of the shell and urging the hot combustion gases into the nozzle box assembly.

9. The dryer as set forth in claim 8 wherein the recirculation fan is disposed adjacent an end of the dryer shell.

10. The dryer as set forth in claim 8 further including turbulence reducing means disposed between the recirculation fan and the channels for reducing the turbulence of the hot gases urged into the boxes by the recirculating fan.

11. The dryer as set forth in claim 8 further including a plurality of distribution vanes disposed between the recirculation fan and the channels for channeling the recirculated hot gases thereto with reduced turbulence.

12. The dryer as set forth in claim 8 wherein the dryer shell includes a pair of end walls, at least one of the end walls having a plurality of exhaust apertures therethrough in communication with an exterior exhaust duct for removing exhaust gases from the interior of the dryer shell, whereby after the hot gases impinge upon the dryer shell interior surface for transferring heat thereto, the gases pass between the channels and are in part recirculated and heated by oxidizing fuel from the burner assembly and in part passed through the exhaust apertures and duct.

13. A jet impingement dryer comprising:

a generally cylindrical dryer shell having an interior surface and an exterior surface over which material to be dried is engaged, the dryer shell having oppositely disposed end walls and being rotatably mounted for rotation around its central axis;

a plurality of longitudinally extending nozzle boxes disposed in a spaced peripheral array and covering a major portion of the circumferential area adjacent the dryer shell interior surface, the nozzles boxes defining a plurality of nozzles for directing jets of gas generally radially toward the dryer shell interior surface;

a burner assembly for oxidizing fuel and hot combustion gases, the burner assembly including means for supplying fuel and air which extends through one of the shell end walls to supply fuel and air to a burner disposed within the dryer shell;

a recirculating fan disposed adjacent the shell other end wall opposite the burner for urging hot combustion gases from adjacent the central axis into the nozzle boxes;

turbulence reducing means disposed between the recirculating fan and the nozzles boxes for reducing the turbulence of hot gases urged into the nozzle boxes; and exhaust passages disposed in one of the shell end walls in communication with an exterior exhaust duct for channeling exhaust gases thereto such that hot combustion gases from the nozzles which have impinged upon the shell interior surface and transferred heat thereto pass between the nozzle boxes and are in part recirculated and reheated by the burner and in part passed into the exhausted duct.

14. A method of drying a material, the method comprising the steps of:

rotating a generally cylindrical dryer shell about a central axis;

passing the material to be dried over an exterior surface of the dryer shell;

combusting fuel to produce hot combustion gases;

directing the hot combustion gases in a first axial direction;

directing the hot combustion gases transversely of the central axis to an area adjacent the dryer shell interior surface;

directing the hot combustion gases in a second, opposite axial direction and thereafter directing jets of the hot combustion gases generally radially outward against the dryer shell interior to transfer heat thereto substantially uniformly over the length and circumference thereof; and, removing the material from the dryer shell exterior surface.

15. The method as set forth in claim 14 further including the step of adjusting at least one of a velocity of the hot gas jets and a rate of combusting the fuel to control the amount of heat transferred to the dryer shell.

16. The method as set forth in claim 14 further including the steps of urging the hot combustion gases into channels extending adjacent an interior surface of the dryer shell and maintaining a generally constant, generally static gaseous pressure therein, the hot combustion gas jets being directed from the channels.

17. The method as set forth in claim 14 further including the step of recirculating at least a portion of the hot combustion gases which have impinged upon the dryer shell by mixing same with new hot combustion gases produced by combusting fuel and directing jets of the mixed gases against the interior of the dryer shell.

18. The method as set forth in claim 17 further including the step of exhausting at least a portion of the combustion gases which have impinged upon the shell interior surface.

* * * * *